US006334542B1

(12) United States Patent
Hsu

(10) Patent No.: US 6,334,542 B1
(45) Date of Patent: Jan. 1, 2002

(54) GARBAGE CAN

(76) Inventor: Chi-Ming Hsu, P.O. Box 453, Taichung (TW)

( * ) Notice: Subject to any disclaimer, the term of this patent is extended or adjusted under 35 U.S.C. 154(b) by 0 days.

(21) Appl. No.: 09/659,422

(22) Filed: Sep. 11, 2000

(51) Int. Cl.[7] ..... B65D 43/16

(52) U.S. Cl. ..... 220/263; 220/826; 220/908; 220/909; 312/319.5; 312/319.6

(58) Field of Search ..... 220/263, 264, 220/908, 909, 826, 827, 262, 260, 503, 505, 523; 312/319.5, 319.6

(56) References Cited

U.S. PATENT DOCUMENTS 4,765,548 A * 8/1988 Sing ..... 220/262
4,883,189 A * 11/1989 Lobbert ..... 220/260
4,981,275 A * 1/1991 Sheu ..... 220/263
5,163,574 A * 11/1992 Sosan ..... 220/263
5,538,338 A * 7/1996 Biggers ..... 220/263
5,779,032 A * 7/1998 Iimura et al. ..... 220/260
6,000,569 A * 12/1999 Liu ..... 220/263
6,010,024 A * 1/2000 Wang ..... 220/263

* cited by examiner

*Primary Examiner*—Nathan J. Newhouse

(57) ABSTRACT

A garbage can has a main body which is provided with a cover, a garbage holder, and a synchronization mechanism assembly enabling the cover and the garbage holder to work synchronously. The synchronization mechanism assembly comprises a motor having a spindle, a drive gear mounted on the spindle of the motor, a toothed piece of the garbage holder, a transmission gear engaged with the drive gear and a toothed piece of the cover, and a control chip for controlling the operation of the motor. As the motor is started, the drive gear is actuated to turn so as to drive the garbage holder via the toothed piece of the garbage holder. The transmission gear is also driven by the drive gear in motion such that the cover is driven by the transmission gear via the toothed piece of the cover.

1 Claim, 5 Drawing Sheets

GARBAGE CAN

BACKGROUND OF THE INVENTION

1. Field of the Invention

The present invention relates generally to a garbage collector, and more particularly to a garbage can.

2. Description of Related Art

There are a variety of garbage cans available in the market place today for the consumer to choose from. These conventional garbage cans are generally rather simple in construction and are provided with very little feature to make them easy and convenient to use. In order to enhance the marketability and the competitiveness of a garbage can, the garbage can should be provided with a semiautomatic device enabling a synchronous motion of the cover and the garbage holder of the garbage can.

BRIEF SUMMARY OF THE INVENTION

It is therefore the primary objective of the present invention to provide a garbage can with a synchronization mechanism to enable the cover and the garbage holder of the garbage can to work at the same time, so as to give an added convenience to the use of the garbage can.

The objective and the features of the present invention will be readily understood upon a thoughtful deliberation of the following detailed description of a preferred embodiment of the present invention with reference to the accompanying drawings.

BRIEF DESCIPTION OF THE SEVERAL VIEWS OF THE DRAWINGS

DETAILED DESCRIPTION OF THE INVENTION

Figure 1:
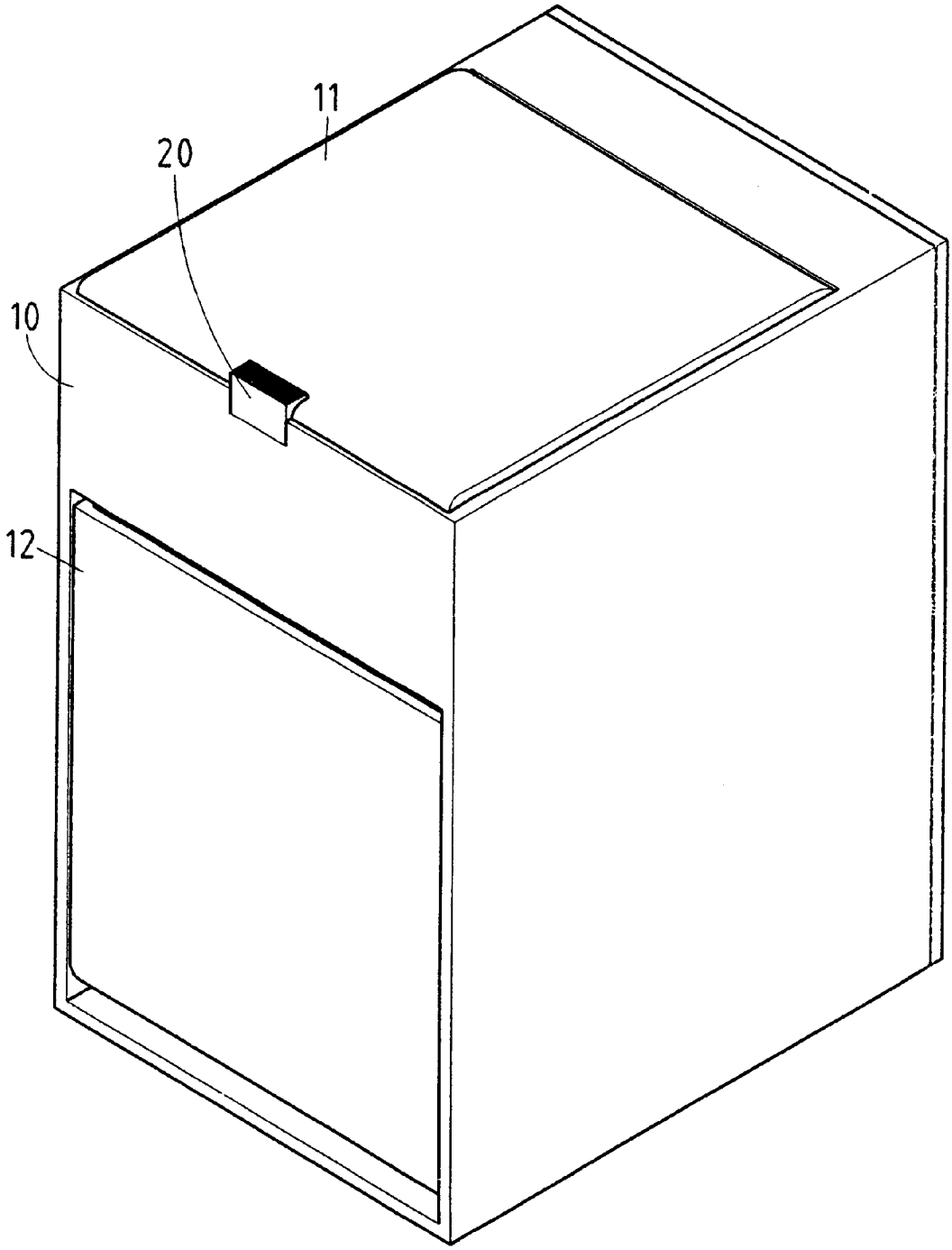
FIG. 1 shows a perspective view of the preferred embodiment of the present invention.
Figure 2:
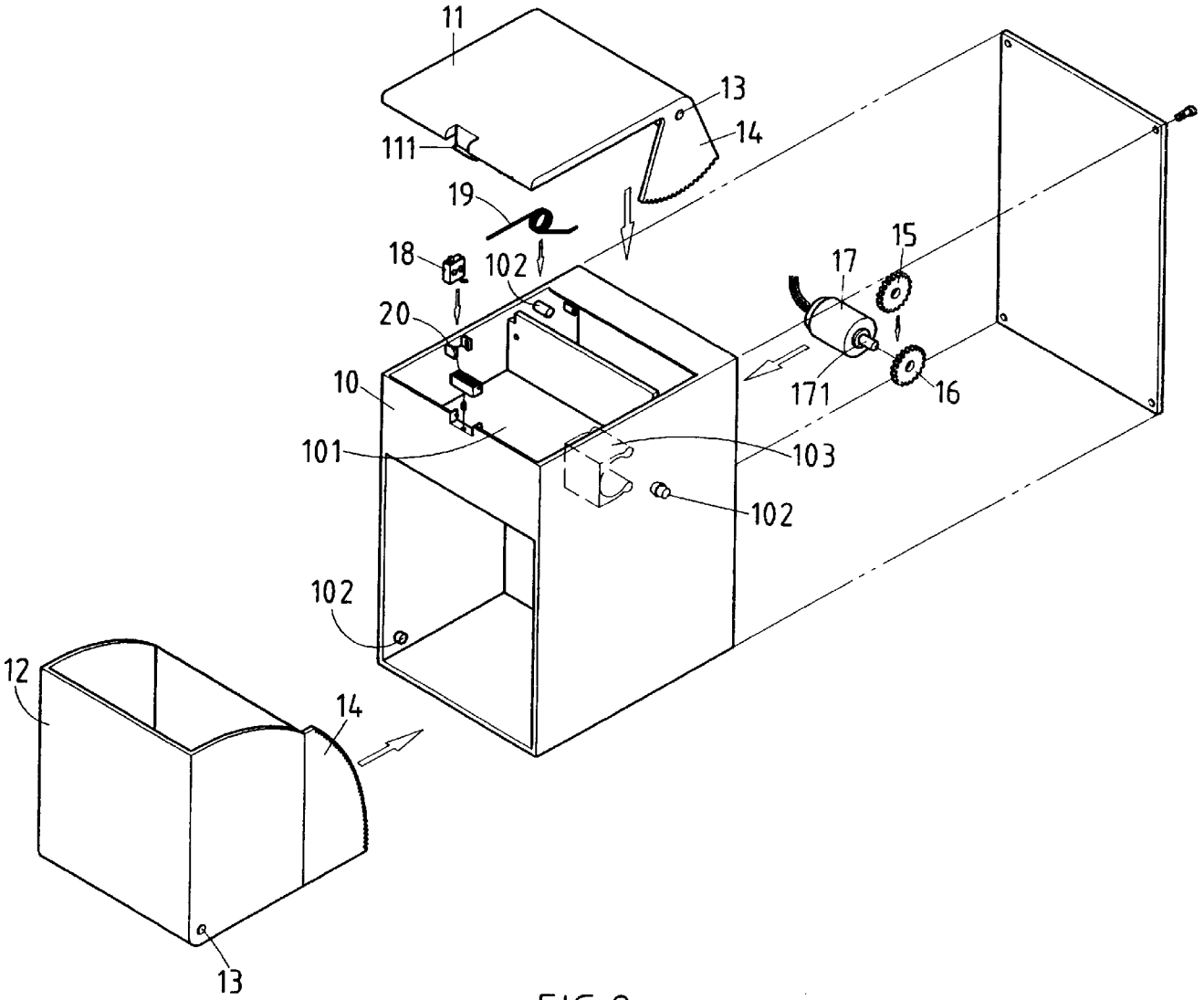
FIG. 2 shows an exploded view of the preferred embodiment of the present invention.
Figure 3:
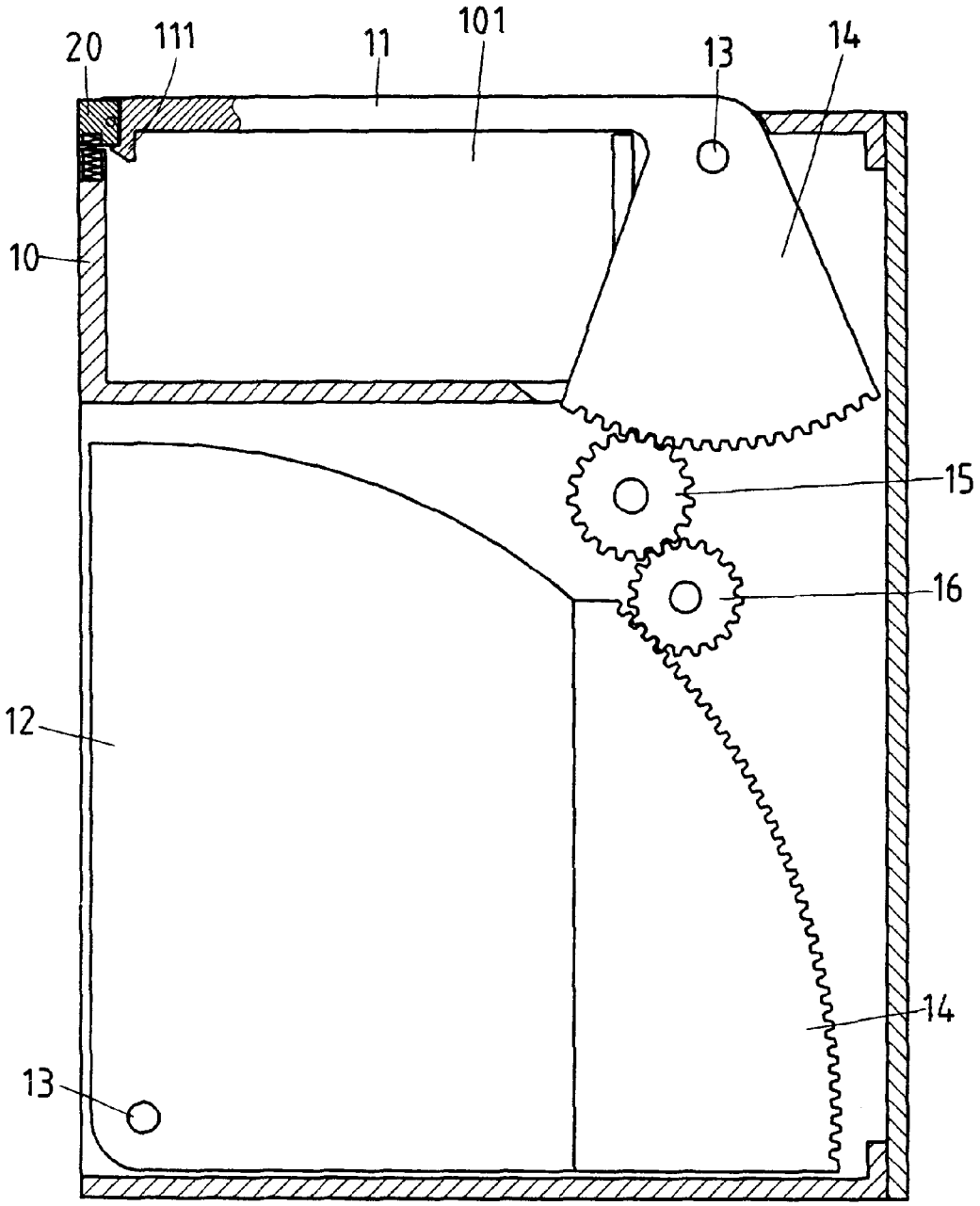
FIG. 3 shows a sectional schematic view of the preferred embodiment of the present invention.
Figure 4:
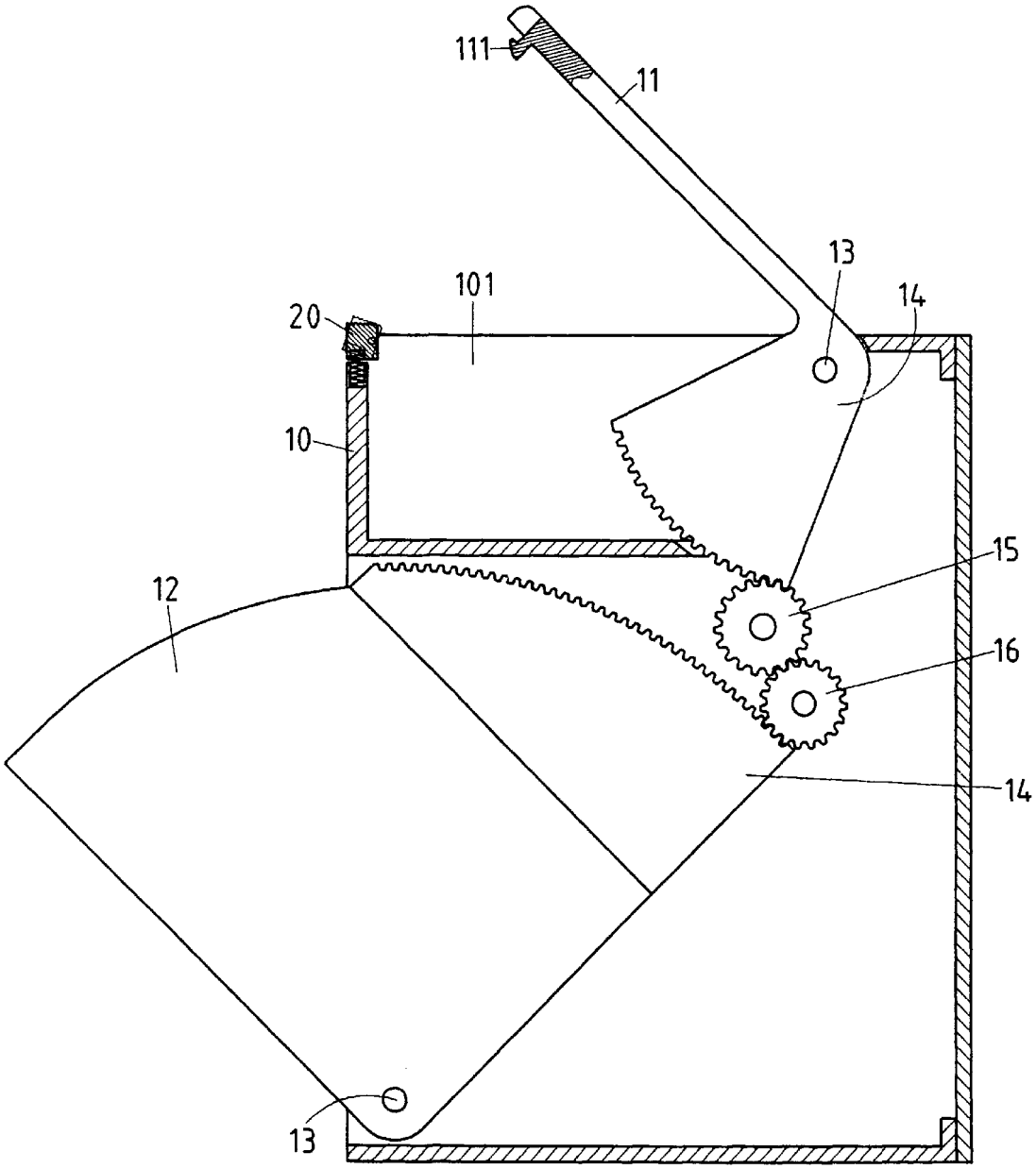
FIG. 4 shows another sectional schematic view of the preferred embodiment of the present invention.
Figure 5:
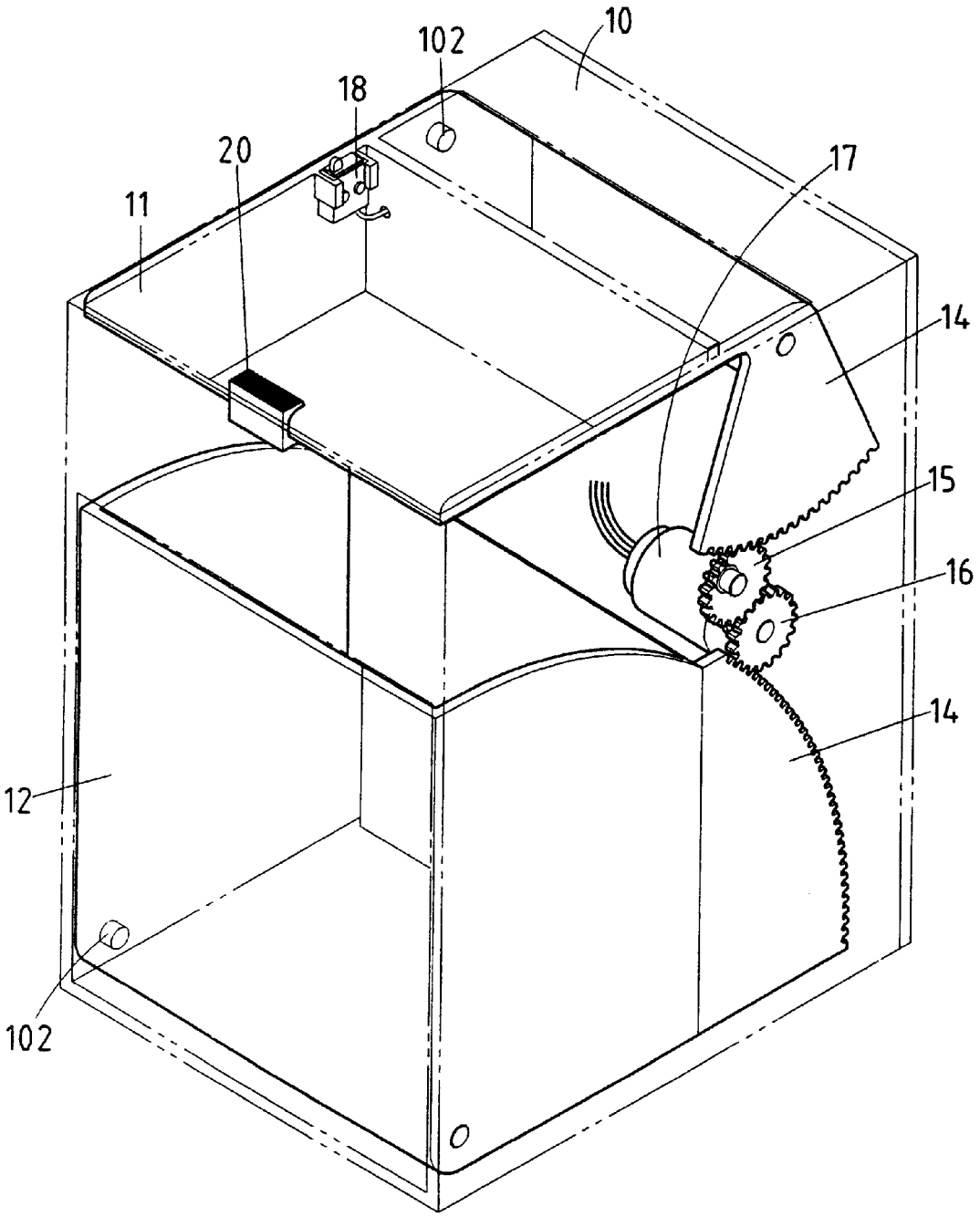
FIG. 5 shows a schematic view of the preferred embodiment of the present invention in use.

As shown in FIGS. 1–5, a garbage can of the preferred embodiment of the present invention has a main body 10 which is provided in the hollow interior thereof with a container 101 and a space located under the container 101 for disposing a garbage holder 12 which is provided in two opposite outer walls thereof with a retaining recess 13. The main body 10 is provided in two opposite inner walls thereof with a retaining projection 102 corresponding in location to the retaining recess 13 of the garbage holder 12. The garbage holder 12 is pivotally disposed in the main body 10 such that the retaining projections 102 of the inner walls of the main body 10 are retained in the retaining recesses 13 of the outer walls of the garbage holder 12.

The main body 10 is further provided in the hollow interior thereof with a synchronization mechanism assembly to enable a garbage can cover 11 and the garbage holder 12 to work synchronously. The synchronization mechanism assembly comprises the cover 11, the garbage holder 12, a motor 17, a drive gear 16, and a transmission gear 15. The main body 10 is provided with a battery set (not shown in the drawings) as the power source of the motor.

The cover 11 is joined with the open top of the container 101 and is provided a toothed piece 14.

The garbage holder 12 is provided with a toothed piece 14.

The motor 17 is mounted on a motor mount 103 and is provided with a spindle 171. The motor 17 is connected with a control chip set (not shown in the drawings) by a circuit (not shown in the drawings).

The drive gear 16 is mounted on the spindle 171 of the motor 17 such that the drive gear 16 is meshed with the toothed piece 14 of the garbage holder 12.

The transmission gear 15 is mounted in the interior of the main body 10 such that the transmission gear 15 is engaged with the drive gear 16 and the toothed piece 14 of the cover 11.

The cover 11 is provided with a retaining piece 111 which is retained by a touch switch knob 20 of the main body 10 at the time when the cover 11 is joined with the open top of the container 101 in which the paper towels and the like are kept. The cover 11 is further provided with a torsion spring 19. The touch switch knob 20 is connected with a switch device 18 which is connected with the control chip set.

In use, the touch switch knob 20 is first pressed to trigger the torsion spring 19 to lift open the cover 11, thereby causing the toothed piece 14 of the cover 11 to drive the transmission gear 15 which in turn drives the drive gear 16. In light of the drive gear 16 being meshed with the toothed piece 14 of the garbage holder 12, the garbage holder 12 is driven to move out of the main body 10 partially. In the meantime, the switch device 18 transmits a timing signal to the control chip set, which in turn transmits a signal to start the motor 17 to actuate the spindle 171 to turn. As a result, the drive gear 16 is driven to actuate the toothed piece 14 of the garbage holder 12 and the transmission gear 15. The garbage holder 12 is therefore driven back into the interior of the main body 10. The cover 11 is synchronously driven to cover the open top of the container 101. While the cover 11 and the garbage holder 12 are opened up, the user of the present invention has access to the paper towel and the like, which are kept in the container 101. The used paper towel is thrown into the garbage holder 12.

I claim:

1. A garbage can comprising:

a main body having a hollow interior which is provided in the top portion with a container for holding paper towels, said main body further having a touch switch knob and a torsion spring connected with said touch switch knob;

a cover pivoted to said main body such that said cover is movably joined with an open top of said container, and that said cover is actuated by said torsion spring to lift open, and over having a toothed piece;

a garbage holder mounted pivotally in the interior of said main body such that said garbage holder is located under said container, said garbage holder having a toothed piece;

a motor mounted in the interior of said main body and provided with a spindle, said motor being connected with a battery set serving as a power source of said motor;

a drive gear mounted on said spindle of said motor such that said drive gear is engaged with said toothed piece of said garbage holder;

a transmission gear pivotally mounted in the interior of said main body such that said transmission gear is engaged with said drive gear and said toothed piece of said cover; and a switch device connected with said touch switch knob and a control chip set whereby said control chip set is disposed in said main body to control the operation of said motor;

said drive gear being actuated by said motor to drive said garbage holder via said toothed piece of said garbage holder at such time when said motor is started, said transmission gear being driven by said drive gear in motion such that said transmission gear drives said cover via said toothed piece of said cover.

* * * * *